US005893777A

United States Patent [19]

Kantor

[11] Patent Number: 5,893,777

[45] Date of Patent: Apr. 13, 1999

[54] ELECTRICAL CONNECTOR MOUNTING DEVICE FOR TRAILER CHASSIS

[76] Inventor: John F. Kantor, 4656 Boatman St., Lake Worth, Fla. 33463

[21] Appl. No.: 08/758,928

[22] Filed: Dec. 3, 1996

[51] Int. Cl.[6] ..... H01R 13/74

[52] U.S. Cl. ..... 439/550; 439/544

[58] Field of Search ..... 439/544, 540.1, 439/553, 533, 527, 34, 35, 369, 550

[56] References Cited

U.S. PATENT DOCUMENTS

| | | | |
|---|---|---|---|
| D. 325,374 | 4/1992 | Ashby | D13/154 |
| D. 332,942 | 2/1993 | Julien | D13/184 |
| D. 344,443 | 2/1994 | Ashby | D8/346 |
| 2,761,112 | 8/1956 | Torcivia . | |
| 2,763,707 | 9/1956 | Sodenberg . | |
| 3,176,257 | 3/1965 | Introvigne . | |
| 3,316,523 | 4/1967 | Trangmar | 439/369 |
| 3,577,115 | 5/1971 | Whitright . | |
| 3,613,044 | 10/1971 | Rarick . | |
| 3,773,969 | 11/1973 | Geisel | 174/67 |
| 3,838,213 | 9/1974 | Georgopulos et al. . | |
| 3,892,911 | 7/1975 | Codrino | 174/59 |
| 4,017,136 | 4/1977 | Sasgen . | |
| 4,278,226 | 7/1981 | Horowitz | 248/314 |
| 4,366,965 | 1/1983 | Rhodes | 280/421 |
| 4,475,649 | 10/1984 | Haarbosch | 206/328 |
| 4,643,505 | 2/1987 | House et al. . | |
| 4,724,791 | 2/1988 | McSorley | 114/343 |
| 4,738,641 | 4/1988 | Eversole, Jr. | 439/528 |
| 5,037,324 | 8/1991 | Scheffey, Sr. | 439/452 |
| 5,191,172 | 3/1993 | Garganese | 174/74 A |
| 5,216,285 | 6/1993 | Hilsenteger et al. | 307/12 |
| 5,378,163 | 1/1995 | Gladura et al. | 439/134 |
| 5,551,888 | 9/1996 | Rhodes, Sr. | 439/369 |

*Primary Examiner*—Gary Paumen
*Attorney, Agent, or Firm*—Quarles & Brady

[57] ABSTRACT

A mounting device for mounting an electrical connector to a trailer chassis for refrigerated containers comprises at least first and second clamp portions. Structure is provided for securing at least one of the clamp portions to the trailer chassis. Structure for securing the first clamp portion to the second clamp portion is provided. At least one of the first clamp portion and the second clamp portion have structure for engaging the electrical connector so as to firmly retain the electrical connector to the trailer chassis. A system and method for mounting an electrical connector and electrical cords to a trailer chassis are also disclosed.

8 Claims, 8 Drawing Sheets

ELECTRICAL CONNECTOR MOUNTING DEVICE FOR TRAILER CHASSIS

FIELD OF THE INVENTION

This invention relates generally to trailer chassis for transporting refrigerated containers, and more particularly to a mounting device and system for mounting electrical connectors to a trailer chassis.

BACKGROUND OF THE INVENTION

Refrigerated containers are utilized to transport perishable goods from place to place on ships and on land. The containers include a refrigeration unit, with a means to power the refrigeration unit. Power to the refrigeration unit can be supplied by an electrical cord which connects to an external power source. On board ship or when stored on land, the electrical cord is connected to ship's power or to shore power. The refrigerated containers are placed on trailer chassis for transporting by trucks to and from the port.

The trailer chassis sometimes has a generator which is used to supply power to the refrigeration unit of the refrigerated container. The electrical cord of the refrigeration unit must be connected to the generator. This electrical cord is usually a four wire cord for a three-phase motor, as is commonly used for refrigeration compressors. A similar cord for the generator is used to connect to the refrigeration unit cord. The generator cord is either hard-wired to the generator or can have a male plug for making a connection to the generator. The refrigeration unit cord is usually between 20 to 40 feet in length and is hard wired to the compressor. The opposite end of this cord has a male plug. Lengths of the cord that are not in use can be coiled in a basket on the container.

The electrical cord connecting the generator to the refrigeration unit blows and flaps in the wind when the trailer is under tow by a truck. This can cause breakage of the electrical cord either at the plug or elsewhere in the power system. It is therefore desired to secure the electrical cord in some manner. A common method of securing the electrical cord is by securing the refrigeration unit cord to an electrical connector that is secured to the trailer chassis. The generator cord is secured to the electrical connector, such that a connection between the two cords can be made by the connector to supply power from the generator to the refrigeration unit. Such electrical connectors are known in the industry, such as those produced by ERO, Inc. of Lake Worth, Fla.

The connector receives a male plug from the refrigeration unit cord, and is wired to an end of the generator cord. The connector assembly provides an in-line, female, water tight enclosure for making this connection.

The connector is secured to the trailer chassis in some manner to secure the electrical cords, and to secure the connector. According to one known connector, a flange with mounting holes is provided on the connector. Bolts or screws are driven through the mounting holes and are secured to the trailer chassis to secure the connector in place. The connector is usually positioned in a hole that is mounted through the trailer chassis. Another hole can be provided in the trailer chassis to receive the generator cord. The generator cord can run from the generator along the frame to the front tongue portion of the trailer chassis, or to a plate or other structure that is provided for mounting the connector to the chassis.

Prior art connectors are not readily changed if breakage occurs. The entire connector unit must be thrown away. The process is time consuming and can result in shipping delays.

SUMMARY OF THE INVENTION

It is an object of the invention to provide a system for securing an electrical connector to a trailer chassis which will prevent movement of the connector during towing.

It is another object of the invention to provide a device for mounting electrical connectors to a trailer chassis which will permit the replacement of only a portion of the connector.

These and other objects are accomplished by a mounting device for an electrical connector which includes a first clamp portion and at least a second clamp portion. The first clamp portion is securable to the second clamp portion by fastening structure. Structure is provided for securing at least one of the clamp portions to a trailer chassis. At least one of the first clamp portion and the second clamp portion have structure for engaging a portion of an electrical connector, to secure the connector, and any electrical cords connected to the connector, to a trailer chassis.

The structure for engaging the electrical connector is preferably contours formed in at least one of the first or second clamp portions, and preferably in both, which contours are adapted to mate with the shape of the electrical connector so as to tightly engage the electrical connector. At least one of the first clamp portion and second clamp portion can have aligning structure for aligning and securing the electrical connector in a desired position. The aligning structure can be a groove which is adapted to receive a protrusion on the electrical connector.

In a preferred embodiment, each clamp portion has a front face, a rear face, and an intermediate web portion. The front face and the rear face are preferably substantially at right angles to the web portion such that each clamp portion is substantially U-shaped in cross section. This provides for contact of the electrical connector in at least two positions, at the front face and at the rear face of each clamp portion.

The first clamp portion is preferably hingeably secured to the second clamp portion. A fastening device such as a bolt can be used to secure the free ends of the first clamp portion and second clamp portion to each other. In this manner, the electrical connector can be easily replaced by removing the bolt and pivoting the first clamp portion relative to the second clamp portion to release the electrical connector for repair. The mounting device can be secured to the trailer chassis by any suitable fastening structure including bolts, screws, welds, adhesives, rivets and the like. Bolts are currently preferred.

BRIEF DESCRIPTION OF THE DRAWINGS

There are shown in the drawings embodiments which are presently preferred, it being understood, however, that the invention is not limited to the precise arrangements and instrumentalities shown, wherein.

DETAILED DESCRIPTION OF THE PREFERRED EMBODIMENTS

Figure 1A:
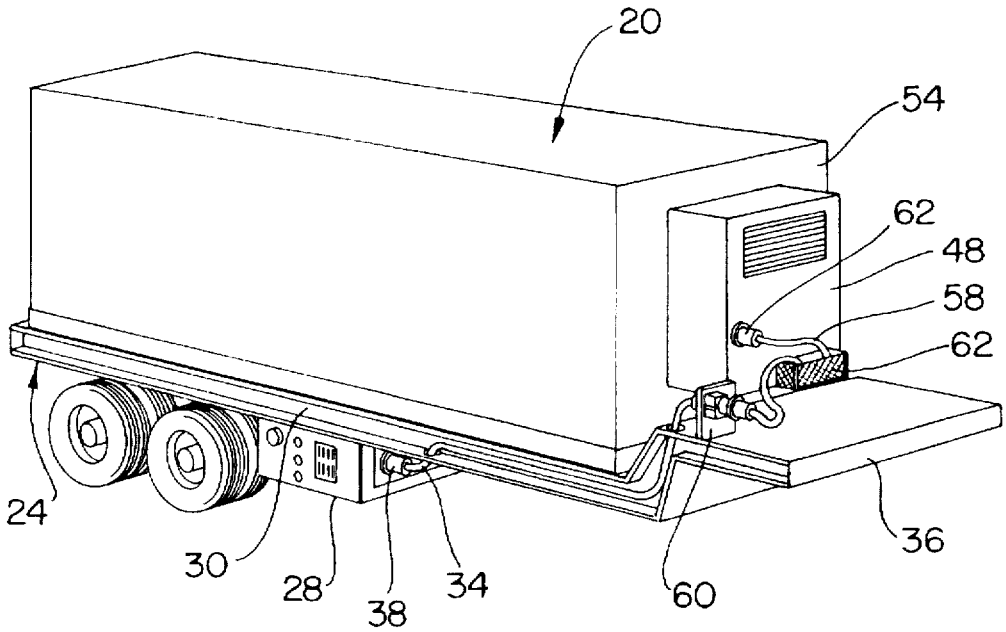
FIG. 1A is a perspective view of a container on a towing trailer chassis.

A container and towing trailer chassis are shown in FIG. 1A. The container 20 rests on the towing trailer chassis 24 and is secured by methods known in the art. The towing trailer chassis has a generator 28 which is typically mounted below the bed 30 of the trailer chassis 24. An electrical cord 34 extends from the generator to the tongue portion 36 of the chassis 24. The generator cord 34 has a male plug at an end 38 that is secured to the generator 28, or can be hard-wired to the generator. The generator cord 34 is connected to an electrical connector at the opposite end. The generator cord 34 is typically threaded through the frame or otherwise secured to the frame to prevent flapping during towing of the trailer.

Figure 1B:
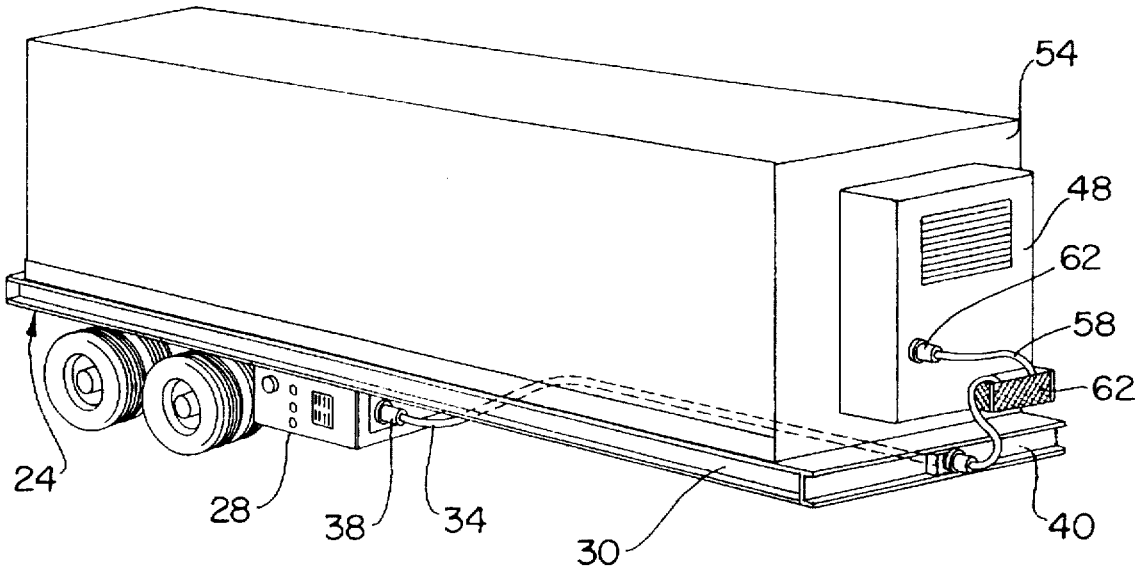
FIG. 1B is a perspective view of a container on an alternative towing trailer chassis.

The container 20 typically has a refrigeration unit 48 mounted to an outside front surface 54 of the container 20. An electrical cord 58 is hard wired to the refrigeration unit at an end 62. The opposite end has a male connector 69. The generator cord 34 extends from the generator along the chassis and can be connected to a plate 60 (FIG. 1A) or threaded through a chassis tongue 36 (FIG. 1B) and secured to a front face 40 of the tongue 36. The refrigeration unit cord 58 extends downwardly from the refrigeration unit for connection to the generator cord 34 or other power supply. A basket 62 is generally provided on the front face 54 of the container to store the refrigeration unit cord 58 when the cord 58 is not in use.

Figure 2:
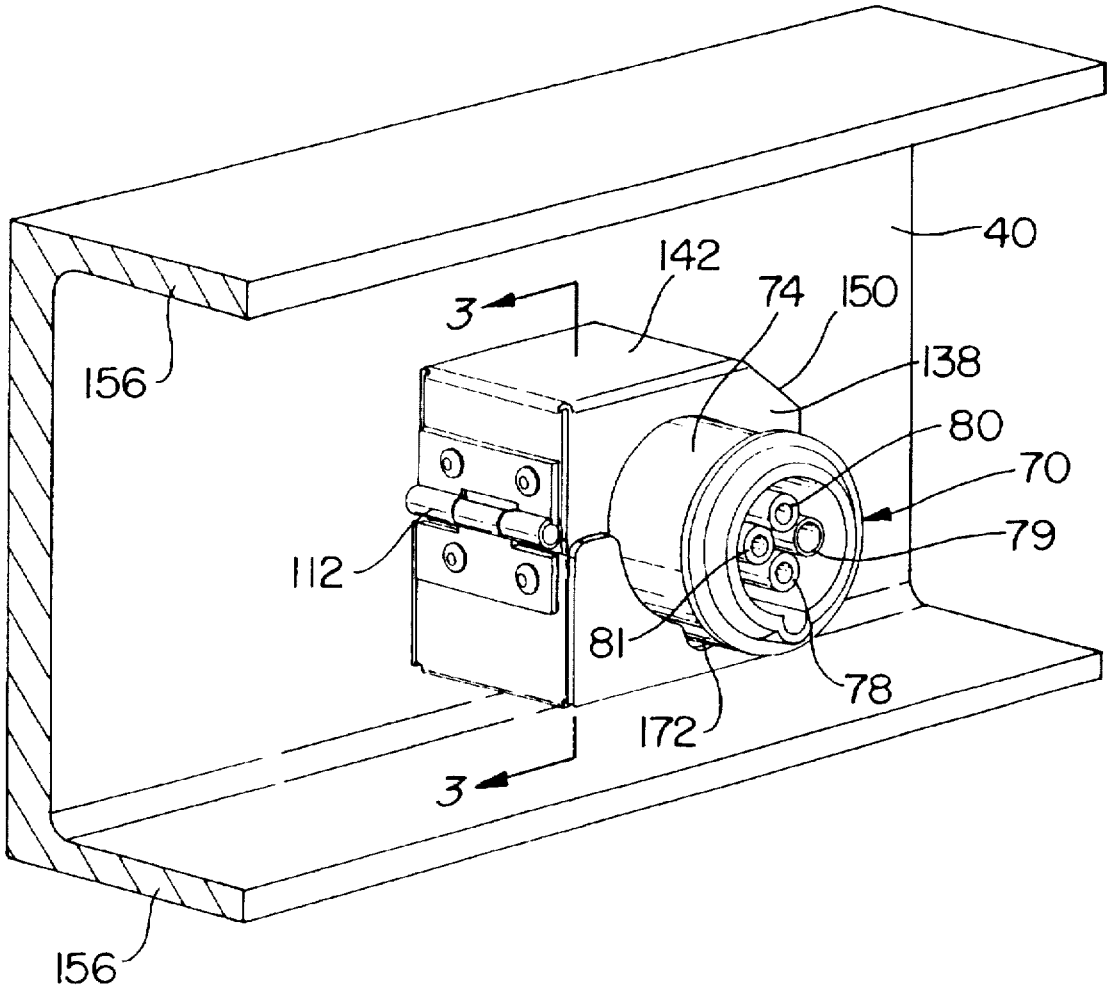
FIG. 2 is a perspective view of an electrical connector secured by mounting device according to the invention.
Figure 3:
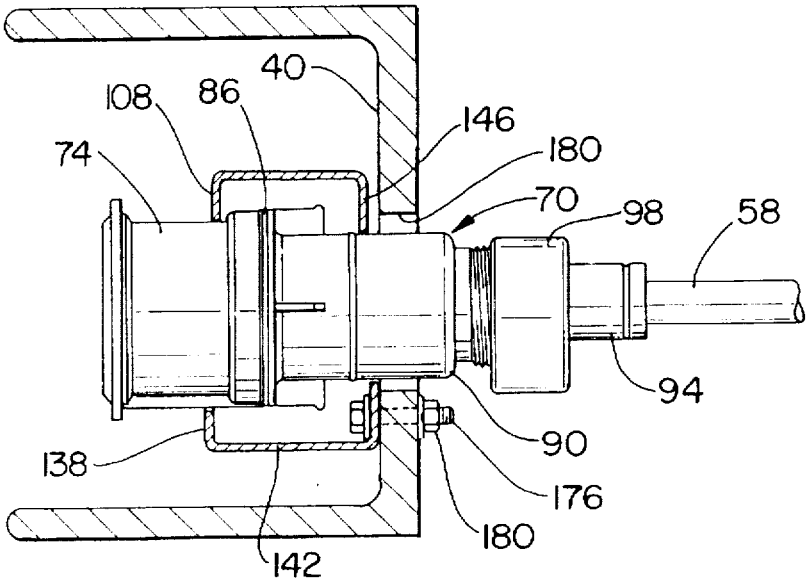
FIG. 3 is a cross section taken along line 3—3 in FIG. 2.
Figure 4:
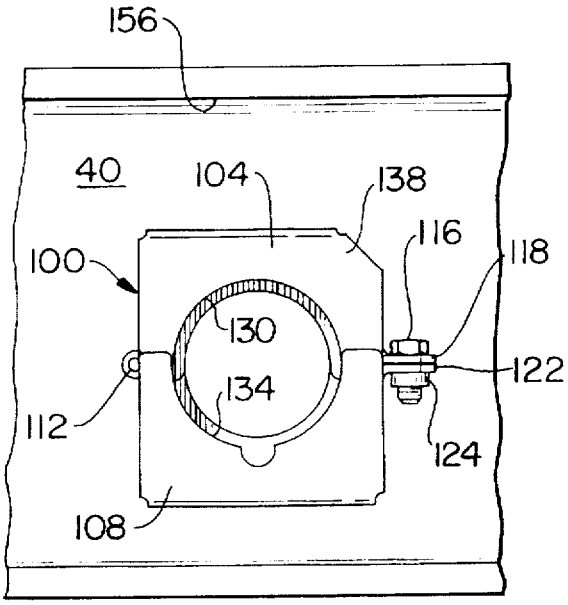
FIG. 4 is a front plan view showing a mounting device according to the invention in a first, securing position.

The electrical connector 70 (FIGS. 2–3) includes a connector housing 74 with sleeves 78–81 for receiving the electrical contacts from a three-phase electrical plug. The connector housing 74 can have female threads (not shown) by which the housing 74 is secured to the male threads 86 of a universal back 90. The universal back 90 provides a water tight enclosure for the male plug of the refrigeration unit cord 58. A rubber bushing 94 and bushing nut 98 are used to seal the plug in the universal back 90 in a water tight fashion.

The mounting device 100 preferably comprises at least a first clamp portion 104 and second clamp portion 108. The first clamp portion 104 is secured to the second clamp portion 108 by suitable structure. According to a preferred embodiment, the first clamp portion 104 is secured to the second clamp portion 108 by a hinge 112. Suitable structure can be utilized to secure the free ends of the first clamp portion 104 and second clamp portion 108, such as the bolt 116, which can be threaded through an aperture 117 in a flange 118 on the first clamp portion 104, which aligns with an aperture 121 in a flange 122 on the second clamp portion 108.

Figure 14:
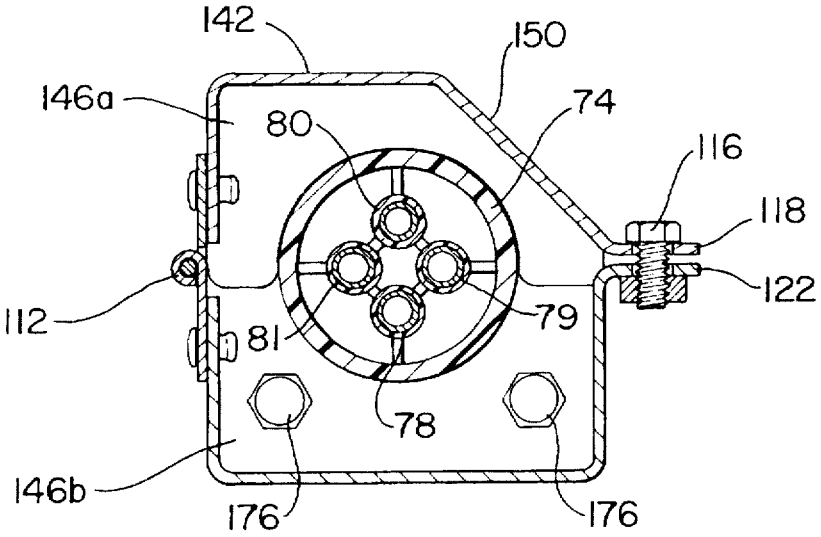
FIG. 14 is a cross section of a mounting device according to the invention as secured to a connector.
Figure 15A:
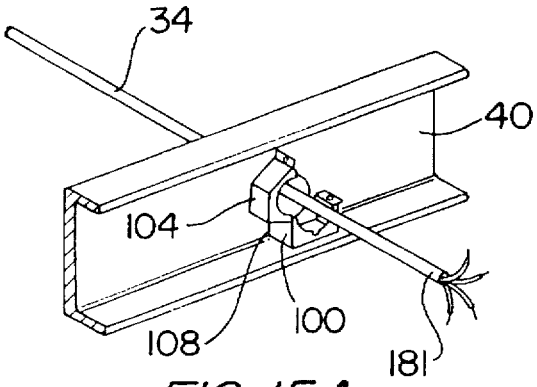
FIGS. 15 A–D are sequential perspective views of a mounting device according to the invention as used to secure a connector and power cords.
Figure 15B:
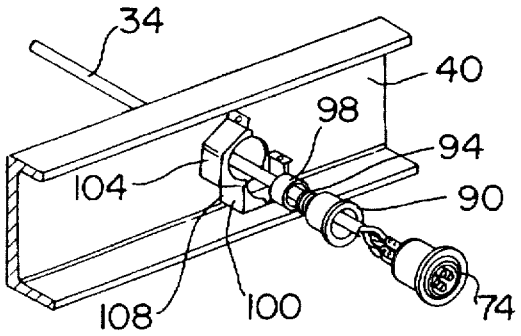
Figure 15C:
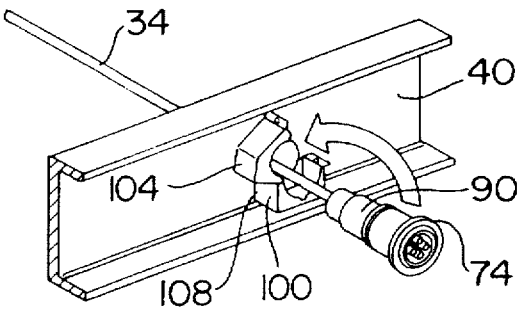
Figure 15D:
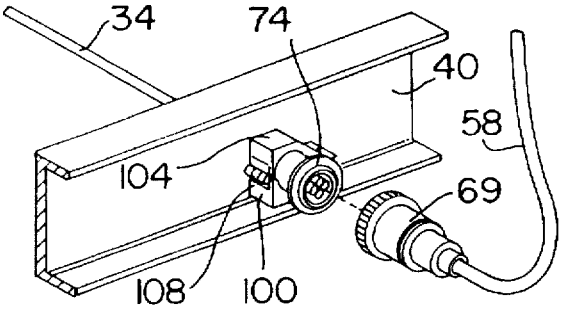

At least one of the first clamp portion 104 and second clamp portion 108 includes structure for engaging the electrical connector 70. This structure is preferably an engagement surface 130 on the first clamp portion 104 and an engagement surface 134 on the second clamp portion 108. These engagement surfaces are preferably contoured and adapted to substantially mate with the exterior surface of a portion of the connector 70 so as to securely engage the connector 70 when the first clamp portion 104 and second clamp portion 108 are engaged (FIG. 14).

Figure 5:
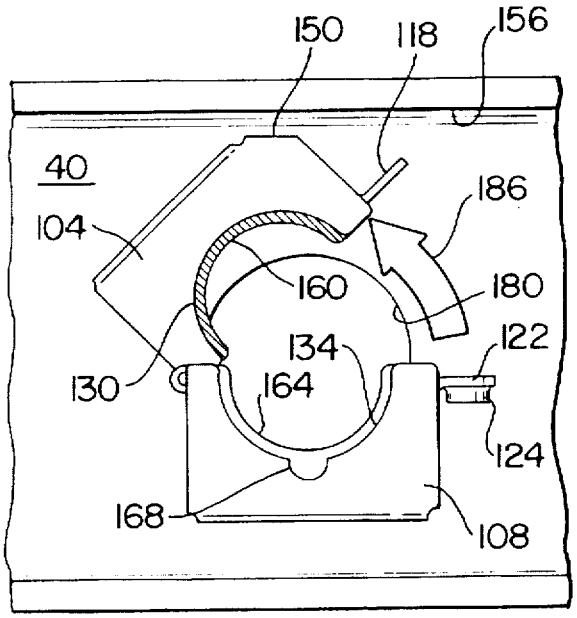
FIG. 5 is a front elevation of a mounting device according to the invention in a second, releasing position.
Figure 6:
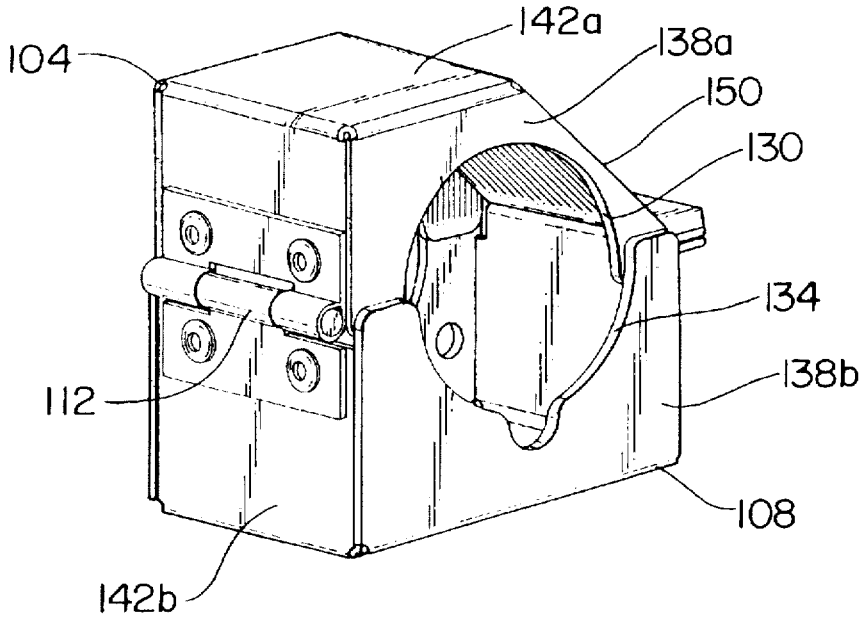
FIG. 6 is a perspective view of a mounting device according to the invention in a first, securing position.
Figure 7:
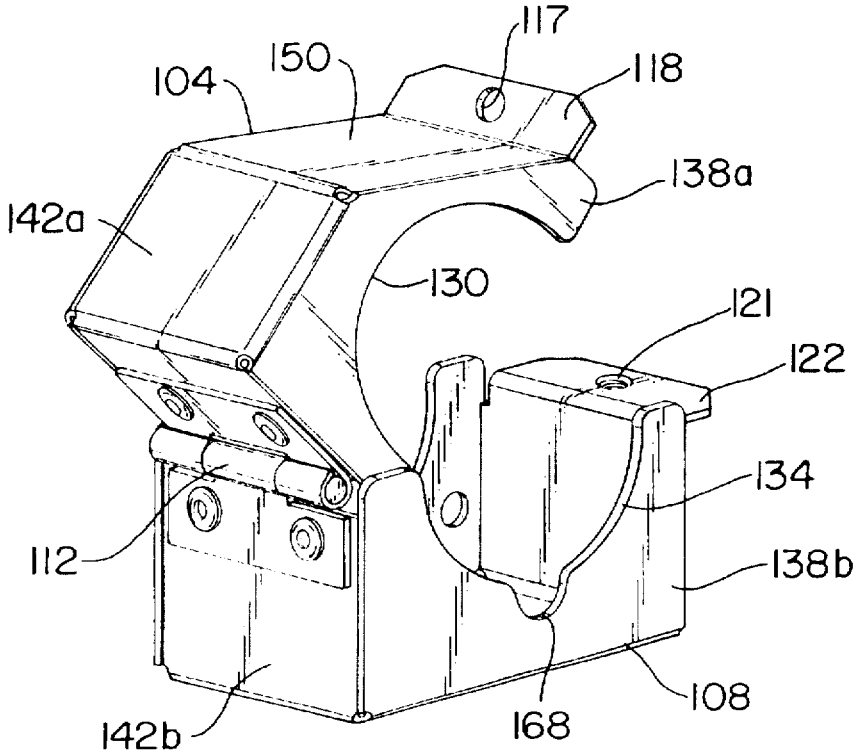
FIG. 7 is a perspective view of a mounting device according to the invention in a second, releasing position.
Figure 8:
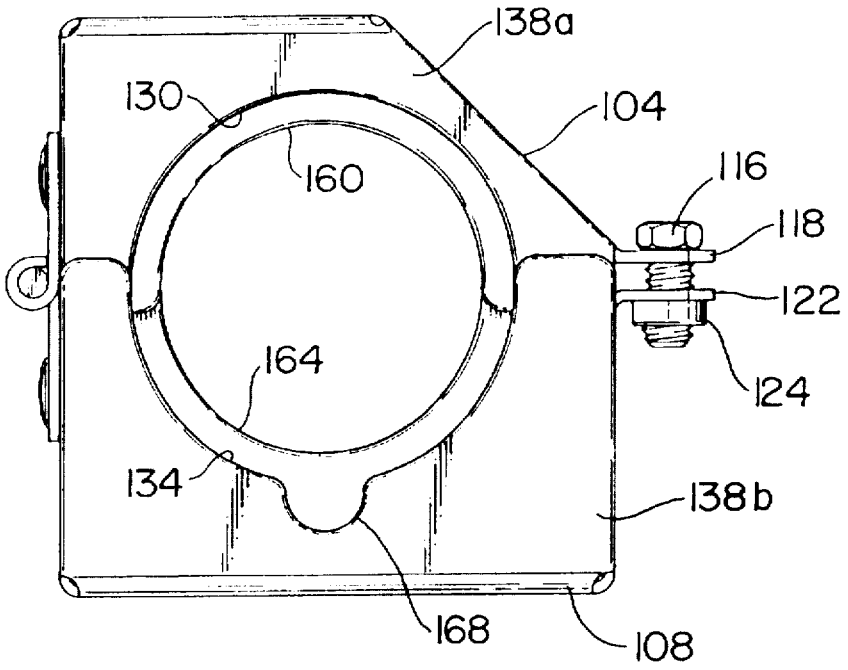
FIG. 8 is a front elevation.
Figure 9:
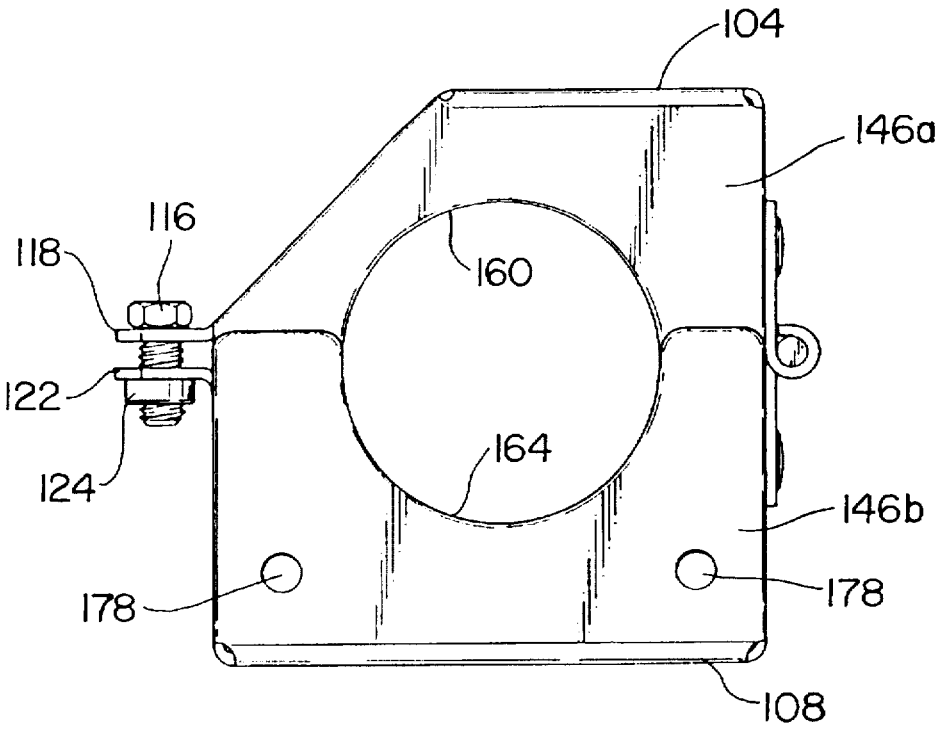
FIG. 9 is a rear elevation.
Figure 10:
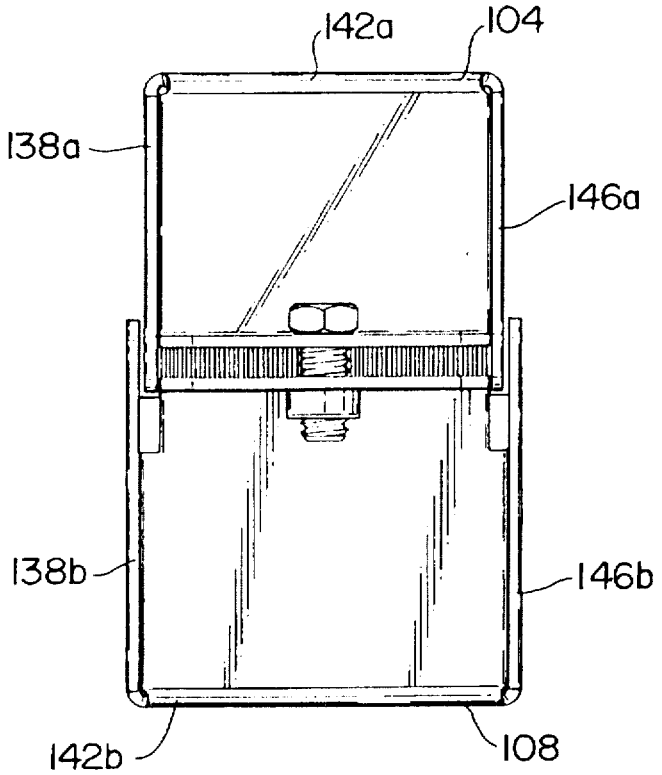
FIG. 10 is a left side elevation.
Figure 11:
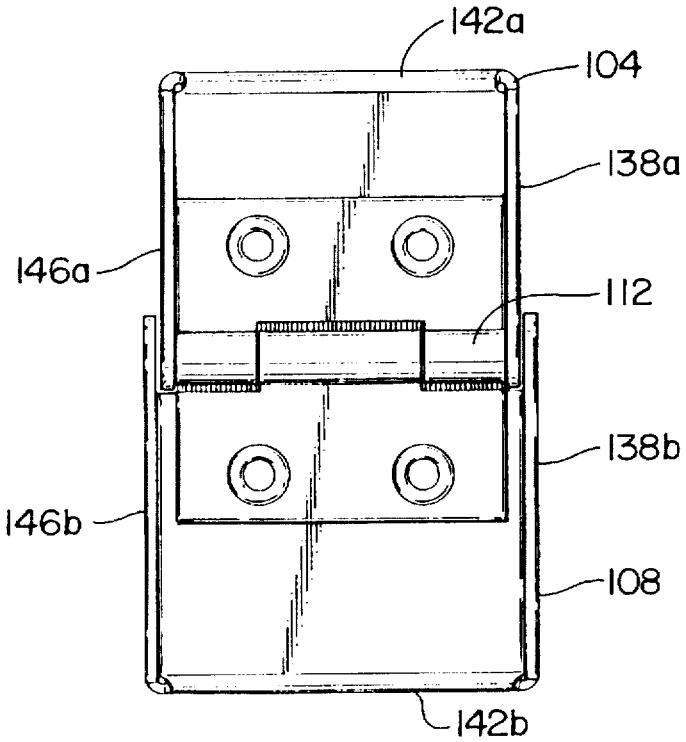
FIG. 11 is a right side elevation.
Figure 12:
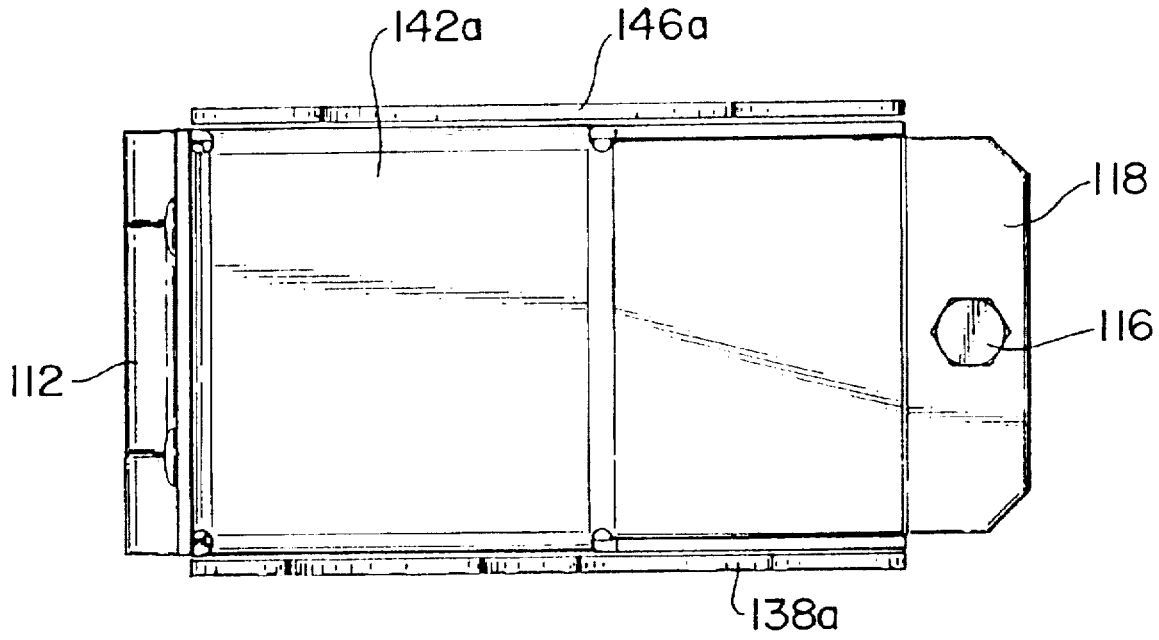
FIG. 12 is a top plan view.
Figure 13:
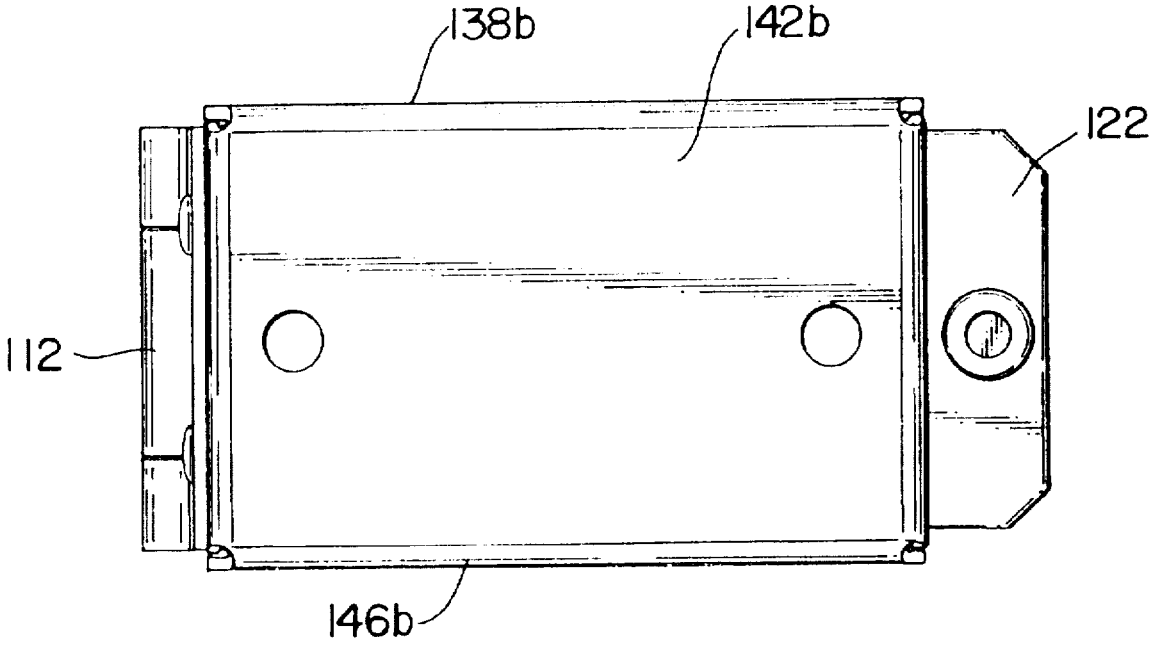
FIG. 13 is a bottom view.

In a preferred embodiment, the first clamp portion 104 and second clamp portion 108 each are substantially U-shaped in cross section. The first clamp portion has a front face **138*a*, an intermediate web portion 142*a* and a rear face 146*a* (FIGS. 6–13). The second clamp portion 108 similarly has a front face 138*b*, an intermediate web portion 142*b*, and a rear face 146*b*. The intermediate web portion 142*a* preferably has a slanted surface 150 which provides clearance when the first clamp portion 104 is pivoted so that the first clamp portion 104 does not strike nearby objects such as one of the side flanges 156 which make up the C-channel of the front of the trailer chassis (FIG. 5). The rear faces 146*a–b* of the mounting device can have contours 160, 164 so as to engage a corresponding portion of the connector 70 in the manner described for the contours 130, 134 of the front face 138. The 2-contour engagement of the connector 70 provides for very firm engagement which will prevent wobble and unwanted movement of the connector 70**.

It is preferable that the connector 70 be properly aligned in the mounting device to facilitate plugging in of the electrical cords into the connector 70. The mounting device preferably has aligning structure to retain the electrical connector 70 in proper alignment. The aligning structure can take any suitable form, but preferably is at least one groove 168 which is adapted to receive an appropriate protrusion 172 on the connector 70 so as to ensure that the alignment is correct. The mounting device will not close properly unless the protrusion 172 is placed into the groove 168. The groove 168 can be formed at either the front face **138*b* or rear face 146*b* of the second clamp portion 108, and can be provided on either the first or second clamp portions, depending on the construction of the connector 70**.

The mounting device can be secured to the trailer chassis by any suitable structure. Suitable fastening structure can include bolts, screws, adhesives, rivets and the like. In a preferred embodiment, bolts 176 are utilized and secured by nuts 180. The bolts 176 pass through appropriate apertures 178 fashioned in the rear face 146 of the mounting device.

In operation, as shown in FIGS. 15 A–D, the connector 70 is fastened to the generator cord 34. The generator cord 34 is placed through the opening 180 (FIG. 15A), with the mounting device 100 in the open position, and is threaded through the universal back 90, bushing 94, and bushing nut 98. The wires at an end 181 of the generator cord 34 are connected to the sleeves 78–81 of the connector housing 74 (FIG. 15B). The universal back 90 is then secured with the bushing 94 and bushing nut 98 in place (FIG. 15C). The connecter remains fixed to the end 181 of the generator cord 34. The connector 70 is secured in the mounting device 100 by placing the connector 70 in the mounting device 100 in proper alignment for secure clamping, and tightening the bolt 116 (FIG. 15D).

When the container 20 is placed on the trailer 30, the refrigeration unit 48 must be electrically connected to the generator 28. The electrical cord 58 from the refrigeration unit 48 is coiled in the basket 62. Upon placement of the container 20 on the trailer chassis 30, the refrigeration unit cord 58 is removed from the basket 62 and the male plug 69 is secured to the connector 70, which is securely retained by the mounting device 100. The connector 70 is positioned in the contours of the first clamp portion 104 and second clamp portion 108, with the protrusion 172 aligned with the groove 168. The first clamp portion 104 is then pivoted to close around the connector 70. The bolt 116 is threaded into the nut 124 to secure the first clamp portion 104 to the second clamp portion 108 and to firmly engage the connector 70. Should the connector 70 break or otherwise need removal or replacement, the bolt 116 is removed and the first clamp portion 104 pivoted in the manner shown by arrow 186 (FIG. 5). The connector 70 can then easily be repaired or replaced.

The mounting device can be made of any suitable material, but preferably is made from a galvanized metal which can withstand the corrosiveness of salt water environments, such as are in ports, and should also be rigid and nonbreakable.

This invention can be embodied in other forms without departing from the spirit or essential attributes thereof, and accordingly, reference should be had to the following claims, rather than to the foregoing specification, as indicating the scope of the invention.

I claim:

1. A system for connecting a generator cord to a container refrigeration unit cord when a container is on a towing trailer chassis, comprising:

an electrical connector having structure for connecting to an electrical cord extending from a generator attached to the trailer chassis, and structure for connecting to an electrical cord of the refrigeration unit of a refrigerated container placed onto the trailer chassis;

a mounting device comprising at least first and second clamp portions, structure for securing at least one of the clamp portions to a trailer chassis, and structure for securing the first clamp portion to the second clamp portion, at least one of the first clamp portion and second clamp portion having structure for engaging the electrical connector.

2. The mounting device of claim 1, wherein the structure for engaging the electrical connector comprises contours in at least one of the first clamp portion and second clamp portion that are adapted to receive the electrical connector.

3. The mounting device of claim 1, wherein at least one of the first clamp portion and the second clamp portion has aligning structure for aligning and securing the electrical connector in a desired position.

4. The mounting device of claim 3, wherein the aligning structure is a groove, said groove being adapted to receive a protrusion on the electrical connector.

5. The mounting device of claim 1, wherein each clamp portion has a front face, a rear face, and an intermediate web portion.

6. The mounting device of claim 5, wherein at least one of said intermediate web portions comprises a slanted surface portion.

7. The mounting device of claim 1, wherein the first clamp portion is hingeably secured to the second clamp portion.

8. The mounting device of claim 1, wherein said structure for securing the clamp portions to a trailer chassis is selected from a group consisting of bolts, screws, rivets, adhesives and welds.

* * * * *